US007020935B2

(12) United States Patent
Behn et al.

(10) Patent No.: US 7,020,935 B2
(45) Date of Patent: Apr. 4, 2006

(54) MULTI-DEVICE TETHER

(76) Inventors: Kristofor R. Behn, 53 Warren Ave., Mansfield, MA (US) 02048; Bryan P. Principe, 89 Hudson St., Providence, RI (US) 02909

( * ) Notice: Subject to any disclaimer, the term of this patent is extended or adjusted under 35 U.S.C. 154(b) by 16 days.

(21) Appl. No.: 10/812,400

(22) Filed: Mar. 30, 2004

(65) Prior Publication Data

US 2005/0217084 A1 Oct. 6, 2005

(51) Int. Cl.
*A44B 21/00* (2006.01)

(52) U.S. Cl. ..... 24/298; 24/3.13; 24/302

(58) Field of Classification Search ..... 24/300, 24/301, 302, 3.13; 119/770, 795; 224/254, 224/269

See application file for complete search history.

(56) References Cited

U.S. PATENT DOCUMENTS

| | | | | |
|---|---|---|---|---|
| 452,830 | A * | 5/1891 | Bowie et al. | 24/3.13 |
| 3,460,207 | A * | 8/1969 | Stewart | 24/302 |
| 4,121,797 | A | 10/1978 | MacNeil | |
| 4,320,883 | A | 3/1982 | Bass | |
| 4,751,896 | A | 6/1988 | Miley | |
| 4,881,746 | A | 11/1989 | Andreesen | |
| 5,150,504 | A | 9/1992 | Cohen | |
| D351,068 | S | 10/1994 | Grimes | |
| 5,702,039 | A * | 12/1997 | Olaiz | 24/3.13 |
| 5,722,125 | A * | 3/1998 | Vasilopoulos | 24/301 |
| D410,971 | S | 6/1999 | Young | |
| 6,000,591 | A | 12/1999 | Alexander | |
| D423,675 | S | 4/2000 | Ramos, IV | |
| D426,699 | S | 6/2000 | Dickerson | |
| 6,425,167 | B1 * | 7/2002 | Barbarite et al. | 24/298 |
| 6,434,800 | B1 * | 8/2002 | James et al. | 24/300 |
| 6,530,131 | B1 * | 3/2003 | Hopkins | 24/300 |
| 2002/0124297 | A1 | 9/2002 | Caris et al. | |

* cited by examiner

*Primary Examiner*—Robert J. Sandy
(74) *Attorney, Agent, or Firm*—Davidson Berquist Jackson & Gowdey, LLP

(57) ABSTRACT

A multiple item carrying device permitting a plurality of items to be conveniently and safely carried, used and retrieved. The carrying device preferably includes an adjustable main strap, a snap-fit closure along the length thereof, a mechanism at one end of the main strap to tether the device to a variety of locations, and a plurality of secondary straps at the other end for holding separate holders to which the items to be carried are secured.

14 Claims, 3 Drawing Sheets

MULTI-DEVICE TETHER

FIELD OF INVENTION

The present invention relates to a device and system for holding a plurality of items conveniently together so that each item is either easy to grab or will be easily retrieved if it falls.

BACKGROUND AND SUMMARY OF INVENTION

For many years various types of tethers have been devised, usually for very specific purposes. Many have been directed to baby or child related needs, in particular to assist parents in retrieving pacifiers the baby spits out or to keep the pacifier from dropping completely to the ground.

One tether device is disclosed in Miley, U.S. Pat. No. 4,751,896 and shows use of a strap with cuff assembly at each end. One cuff would be attached to a wrist of the parent, for example, and the other to the wrist of a child, to restrain the child's movement. Depending on the length of the strap the child can move about on his/he own, but be under the control of the adult at all times.

Another type of child related tether assembly relate to pacifiers and exemplary of theses are Cohen, U.S. Pat. No. 5,150,504 and Ramos, IV U.S. Pat. No. Des. 423,675. Cohen discloses a device that can be attached on a child's shirt or other article of clothing and uses an o-ring and flexible strap that extends through one end of the device for holding a pacifier. Ramos discloses a zippered pouch and an attached cord that connects between the pouch and a pacifier.

Another group of devices include those designed for holding multiple toys or dolls. These include, Young, U.S. Pat. No. Des. 410,971, Alexander, U.S. Pat. No. 6,000,591, Dickerson, U.S. Pat. No. Des. 426,699 and Caris et al. Published Application No. U.S. 2002/0124297 A1 (now abandoned). Young shows an octopus style animal with lines extending from its legs for holding toys. Alexander discloses use of a sewed strap assembly with elastic loops extending out from each side for holding a number of dolls. Dickerson shows a belt with depending loops, fixed to the belt, on which toys can be attached. Caris et al. also uses a belt, that can be placed around a child's waist or be used to hang the device from a high chair, car seat or walker, and from which depending straps are used to hold toys at their ends by a VELCRO fastener.

Various clamp-on or attachable supports have been designed to hold child related objects including toys and bottles. Bottle holders are shown in MacNeil, U.S. Pat. No. 4,121,797 and Bass, U.S. Pat. No. 4,320,883. Clamp on toy holders are shown in Andreesen, U.S. Pat. No. 4,881,746 and Grimes, U.S. Pat. No. Des. 351,068.

None of these devices, however, are designed to permit a variety of objects to be held, or available for use by removal from the holder and then restored in the proper holder. None go beyond toys or pacifiers, none relate to a wide variety of items and none are useful in a variety of settings including sport's activities and the workplace uses. Further, none of the known tether systems are useful by those who are somehow disabled, by stroke victims or by others who may be confined, for example, to their home, to wheel chairs or in bed. Such individuals may be living in nursing homes or various other types of long term care facilities or other medical institutions. Known tether systems have not been designed for use by any person who might drop something that would otherwise be irretrievable or very difficult to retrieve.

In the present invention, an improved holder is formed from a first elongated strap that can be of varying lengths depending upon the task at hand and the items to be held. Additionally, when a devise like a snap fit clasp is used along the length of this main strap, as in the present invention, the length can be adjusted, lengthened or shortened, to suit an immediate need, and the item holding portion can be disengaged from the tethered portion for easy use of the items being held. The type and form of the items can range from children's toys to children's equipment, including spill proof cups, or articles of clothing such as gloves and hats. Alternatively, the present invention could be used by climbers, workmen, factory workers, individuals working on assembly lines or any type of activity where a person will be separated from their normal tool supply. In addition, the present invention could also be used by an elderly or disabled person, or a person confined to a bed or wheel chair that might have great difficulty retrieving an items if it were untethered and dropped out of reach.

In another aspect of the present invention, the holder can permanently hold an item, so that it will be used with the tether attached alternating the holder for the item might permit the item to be removed from the separate holder that forms part of the holder device and then, following use, be returned to the holder. For example, where a child's toy is the item in question, it may be dropped frequently during play sometimes by accident and sometimes on purpose and the tether permits easy recovery and prevents the toy from hitting the floor prior to retrieval. Alternatively, the device may be used by an individual working on a roof and the item may be a staple gun. Here, the staple gun might remain attached to the holder as it is being used, or it might be removable from its separate holder for use and then replaced following use. As another example, this device may be used by an infant or toddler in their car seat or in a seat on a commercial airliner to prevent items in use from falling beyond the reach of the infant/toddler or parent or from coming in contact with the floor.

Further, improvements and advantages of this invention will readily appear to those skilled in the art when the following description is read in view of the accompanying drawings, wherein an illustrative embodiment is set forth that should not be considered as limiting the scope of the present invention

BRIEF DESCRIPTION OF THE DRAWINGS

For a more complete understanding of the present invention, and the advantages thereof, reference is made to the following Detailed Description in conjunction with the accompanying drawings in which.

DETAILED DESCRIPTION OF THE INVENTION

Figure 1:
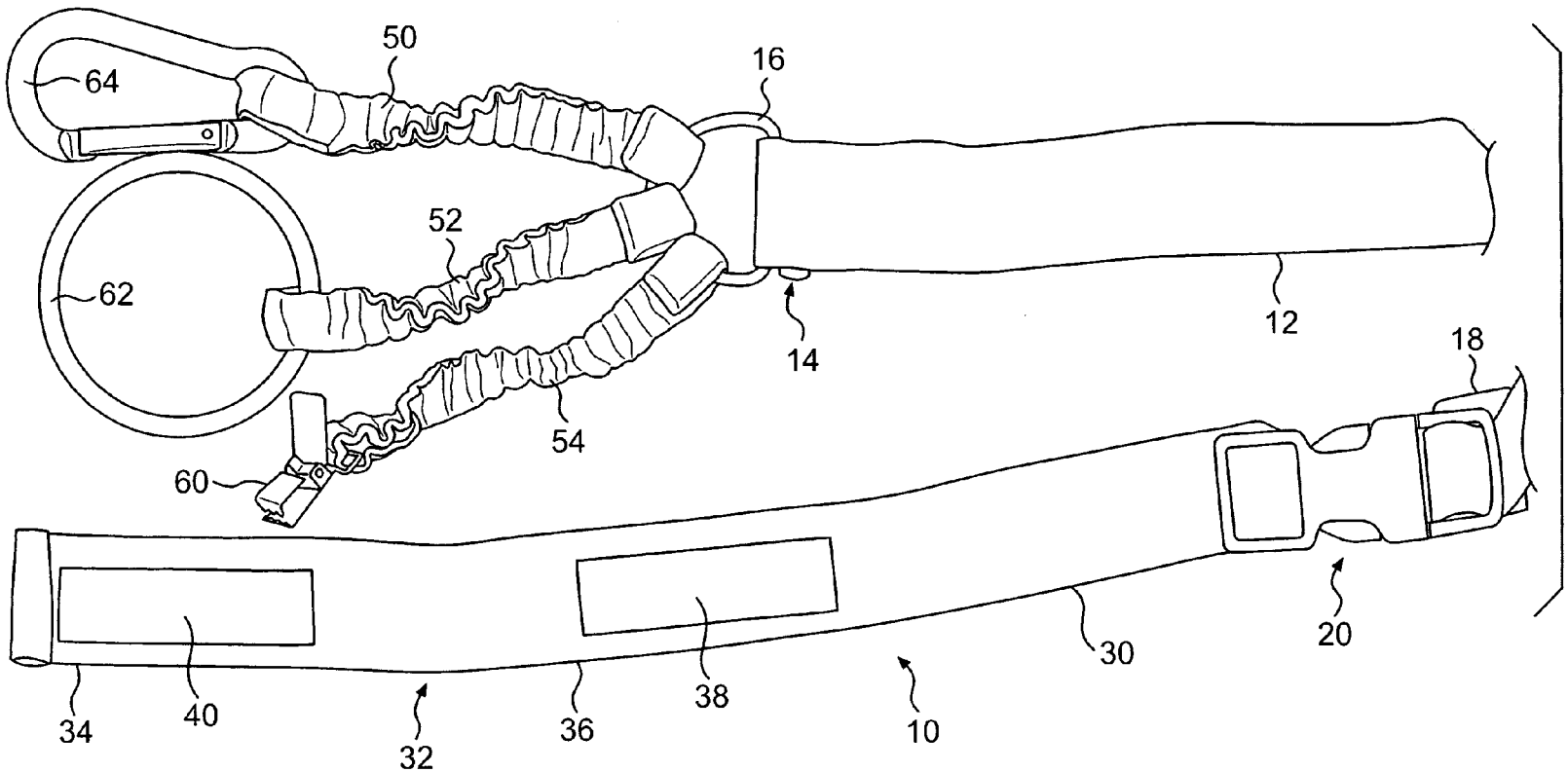
FIG. 1 is a top plan perspective view of the holder in accordance with the present invention showing both ends with the main attaching mechanism in its open condition.

Referring now to FIG. 1, the present invention comprises a holder shown at 10 and includes a main elongated strap 12, preferably woven or otherwise formed from a durable material such as nylon or polyester, although other materials can be used such as cotton or leather. The strap 12 could also be formed as a one-piece molded strap. This main strap 12 can have a width varying from about one half an inch to about an inch and a half, and can be formed from a very flexible material, or alternatively, it can be quite stiff, again depending upon its designed use.

Main strap 12 has a first end 14 that is joined, such a by a sewn seam, to a connector 16. Connector 16, as shown, is in the form of a metal D-ring, but other shaped connectors could be used, and formed from any other strong material, including nylon, carbon fiber or even reinforced materials.

Figure 3:
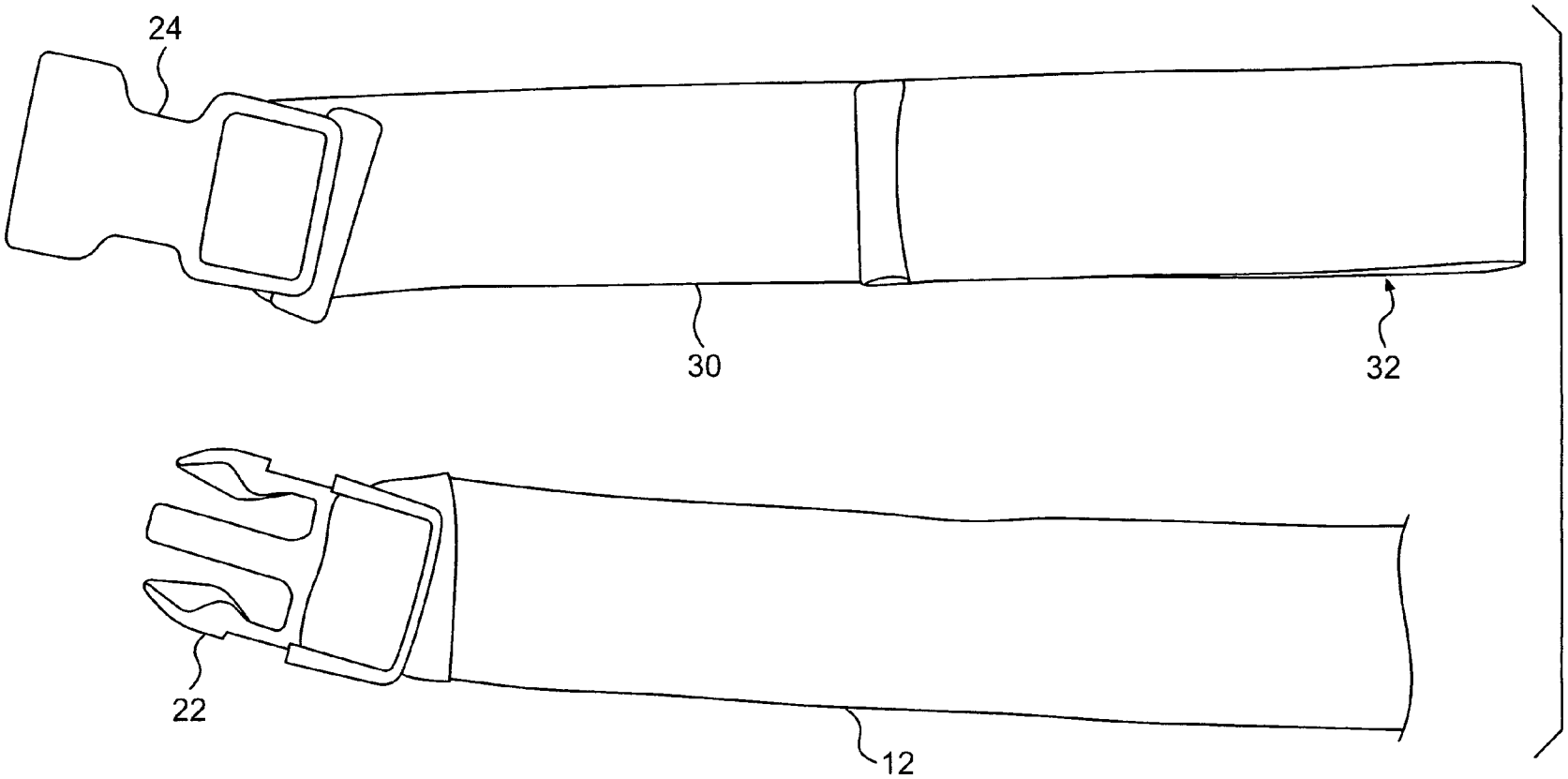
FIG. 3 is a view of an additional clip mechanism provided in the main strap in its un-clipped condition.

Strap 12 could be a continuous member, or, as an alternative and as shown in FIG. 1, the other end 18 of strap 12 can be, for example, be connected to a snap fit closure 20, and in FIG. 1 snap fit closure 20 is shown in its closed or secured condition. Snap fit closure 20 is shown in its open condition in FIG. 3, and its male and female portions are visible, 22 and 24, respectively. Snap fit closure 20 is a standard type of removable closure assembly that permits the tow portions to be separated from one another. In addition, the strap connections are adjustable to permit straps 12 and 30 to be shortened or lengthened as desired. Consequently, further description of straps 12 or 30 is not believed to be needed for one skilled in the art to understand its construction and use.

Figure 2:
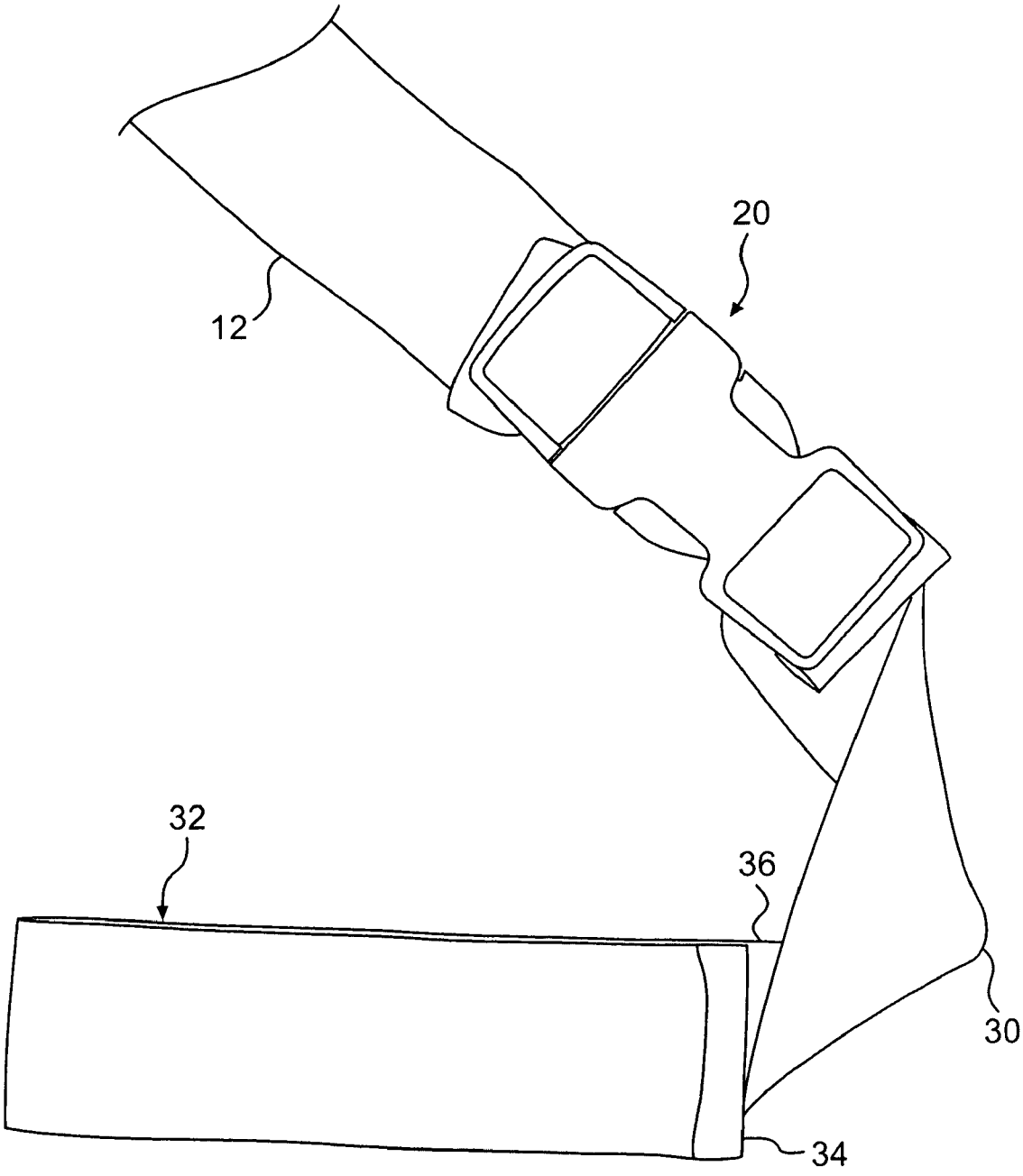
FIG. 2 is a top plan perspective view of one end thereof showing the main attaching mechanism in its closed condition.

A short strap 30 is connected to the male end 24 of snap fit connector 20 and the other end 32 of strap 30 is comprised of two portions 34 and 36 which are folded over on each other. As shown in FIG. 2, each folded over portion, 34 and 36, includes, on an inner surface thereof, complementary portions of a VELCRO hook and loop fastener material, shown at 38 and 40. Other approaches could be used instead of VELCRO straps 38 and 40. For example, a pressure clip (not shown) could also be used in place of the VELCRO at the end of strap 30, or a snap or even a form of hook or spring closed clip could be employed. What is important is that strap 30, or the end of strap 12 if a one-piece was used. End 32 is shown as being part of a shorter strap 30 with the clip 20 permitting the main strap 12 to be separated from the shorter one 30. The folded over fastened or clipped end can be used to attach the device 10 for example to a wide variety of structures including, but not limited, chairs, strollers, portions of bicycles, ladders, belts, backpacks, wheelchairs, wagons, grocery carts, shower valves, bed in medical facilities, movie theater seats among other.

One end of a plurality of secondary straps, 50, 52 and 54, respectively, are connected to D-ring 16, for example, by a sewn loop. However, other forms of connection, such as welds, glue, or other type of closure could be used. In fact, a snap or VELCRO type connection could be used where detachability was desirable.

The other end of each of the secondary straps 50, 52 and 54 are, respectively, connected to separate holders, including, but no limited to, for example, a snap-closed clamp 60, a solid ring 62 and a spring closed clip 64.

A snap-type clamp 60 works well with any article comprised of soft material, such as, for example, clothing and is a simple yet secure mechanism for securely holding such types of items to the device.

The solid ring 62 can be formed from a variety of materials including hard, unyielding materials, including metals, resins or thermoplastics, or, alternatively, an elastic material, such as a yieldable or stretchable plastic or rubber, so that it could snugly fit around a child's spill proof cup, bottle or other similar type of container. In an industrial or working environment, ring 62 could be used to hold a variety of tools including screw drivers, hammers, files or other such tools, with the holding capability being defined by the size of the ring's inner diameter and the material used to construct ring 62.

The spring closed clip 64 is another conventional attaching member that will function to hold a variety of items to the holding device. For example, if shoes or boots were tied together by their laces, clip 64 could hold them to the device. A staple gun could be held by clip 64 that would be large enough to receive part of a handle therein. Like wise a saw, drill or other tool could be similarly held by its handle in clip 64. Such spring clips can conveniently hold a wide variety of items where a handle or some opening exists in the item around which the clip might fit. For the elderly the tether could hold pill holders, an emergency warning indicator, keys or other similar items an elderly person needs to have access to quickly, or might seem to loose or misplace a lot.

While the separate holders 60–64 have been shown as each being different from one another, each could be exactly the same or similar in type, but differing in size. For example, a lathe operator might wish to have a series of cutting tools at his side, each with a different cutting tip. By using several rings constructed in an appropriate size range, from smaller to larger, or constructed from an elastic material, would permit a variety of the desired series of tools to be held. This would also apply to a series of screw drivers of different sizes and types. For children, several spill proof cups might be held at the same time each with a different liquid or one each for use by several different children.

Three of the secondary straps 50, 52 and 54 have been shown, but it should be understood that more or less than that can be employed, with the limit being subject, to some extent, by the types of items to be held, the size and construction of the connector ring 16, the size of the secondary straps or some combination of the above.

While the present invention and its advantages has been described in detail in connection with what is presently considered to be the most practical and preferred embodiment, it should be understood that the present invention should not be limited to the disclosed embodiment, but on the contrary, is intended to cover various changes, substitutions and alterations therein, including in the configuration and assemblage of the various parts comprising the present invention, without departing from the spirit and scope of the invention as defined by the appended claims, which changes, substitutions and alterations are intended to be embraced therein.

What is claimed is:

1. A holder for multiple items comprising:

a first elongated strap with two ends and including a first attachment mechanism at one end, a connector attached to the other end of said first elongated strap, a plurality of secondary elongated straps, each for removably holding an independent item, each of said secondary straps having two ends one of which is secured to said connector with the other end being connected to a separate holder; and a second strap and a releasable closure connected there between.

2. The holder as in claim 1, wherein each of said separate holders are identical.

3. The holder as in claim 1, wherein each of said separate holders are each different from one another.

4. The holder as in claim 1, wherein each of said secondary straps is elastic.

5. The holder as in claim 1, wherein each of said separate straps is formed from a stiff material.

6. The holder as in claim 5, wherein the stiff material has some degree of flexibility.

7. The holder as in claim 1, wherein said separate holders comprise rings.

8. The holder as in claim 1 wherein said separate holders comprise spring closed clamps.

9. The holder as in claim 1 wherein said separate holders comprise snap clips.

10. The holder as in claim 1 wherein said first elongated strap is a molded, one-piece structure.

11. The holder as in claim 1 wherein said second strap includes a second attachment member spaced from said releasable closure.

12. The holder as in claim 11 wherein said second strap is comprised of a molded material.

13. A holder for multiple items comprising:

a first elongated strap with two ends and including a first attachment mechanism at one end, a connector attached to the other end of said first elongated strap, a plurality of secondary elongated straps, each for removably holding an independent item, each of said secondary straps having two ends one of which is secured to said connector with the other end being connected to a separate holder, and second strap and a releasable closure connected therebetween, wherein said second strap includes a second attachment member spaced from said releasable closure.

14. A holder for multiple items comprising:

a first elongated strap with two ends and including a first attachment mechanism at one end, a connector attached to the other end of said first elongated strap, a plurality of secondary elongated straps, each for removably holding an independent item, each of said secondary straps having two ends one of which is secured to said connector with the other end being connected to a separate holder, and second strap and a releasable closure connected therebetween, wherein said second strap is comprised of a molded material.

* * * * *